US007846381B2

(12) United States Patent
Braga

(10) Patent No.: US 7,846,381 B2
(45) Date of Patent: Dec. 7, 2010

(54) FERRITIC DUCTILE CAST IRON ALLOYS HAVING HIGH CARBON CONTENT, HIGH SILICON CONTENT, LOW NICKEL CONTENT AND FORMED WITHOUT ANNEALING

(75) Inventor: Cesar Augusto Rezende Braga, Shawano, WI (US)

(73) Assignee: Aarrowcast, Inc., Shawano, WI (US)

( * ) Notice: Subject to any disclaimer, the term of this patent is extended or adjusted under 35 U.S.C. 154(b) by 418 days.

(21) Appl. No.: 12/021,327

(22) Filed: Jan. 29, 2008

(65) Prior Publication Data

US 2009/0191085 A1 Jul. 30, 2009

(51) Int. Cl.
*C21C 1/10* (2006.01)
*C22C 37/04* (2006.01)

(52) U.S. Cl. ..... 420/13; 148/543; 148/612; 148/614; 148/618; 148/321; 420/15; 420/16; 420/18; 420/26; 420/27

(58) Field of Classification Search ..... 148/321, 148/543–545, 612–618; 420/13–33
See application file for complete search history.

(56) References Cited

U.S. PATENT DOCUMENTS 3,415,307 A * 12/1968 Schuh et al. ..... 148/539
3,549,430 A * 12/1970 Kies et al. ..... 420/17
3,954,133 A * 5/1976 Miyaoka et al. ..... 148/540
4,040,821 A 8/1977 Hetke et al.
4,157,111 A 6/1979 Tanaka et al.
4,166,738 A 9/1979 Plessers
4,224,064 A 9/1980 Bilek et al.
4,391,636 A 7/1983 Windish
4,396,442 A 8/1983 Nakamura et al.
4,401,622 A 8/1983 Benn et al.
4,450,019 A 5/1984 Satou et al.
4,475,956 A 10/1984 Kovacs et al.
4,484,953 A * 11/1984 Kovacs et al. ..... 148/545
4,536,232 A 8/1985 Khandros et al.
4,619,713 A 10/1986 Suenaga et al.
4,702,886 A 10/1987 Kent
4,762,555 A 8/1988 Henych et al.
4,874,576 A 10/1989 Reifferscheid
4,889,687 A 12/1989 Ishihara et al.
4,889,688 A 12/1989 Suenaga et al.
4,971,623 A 11/1990 Wilford
5,059,257 A 10/1991 Wanner et al.
5,373,888 A 12/1994 Backerud (Continued)

OTHER PUBLICATIONS

Ductile Iron DCI (A395), Flowserve Corporation, May 1999.*

(Continued)

*Primary Examiner*—Deborah Yee
(74) *Attorney, Agent, or Firm*—Andrus, Sceales, Starke & Sawall, LLP

(57) ABSTRACT

Disclosed are methods of making ferritic ductile iron castings (60-40-18) with high toughness (6 ft.lb minimum Charpy V at −20 F and 10 ft.lb minimum Charpy V at +72 F), without adding Nickel and without annealing.

28 Claims, 12 Drawing Sheets

U.S. PATENT DOCUMENTS

| | | | |
|---|---|---|---|
| 6,110,422 | A | 8/2000 | Suarez |
| 6,533,998 | B2 | 3/2003 | Van Eldijk et al. |
| 6,613,274 | B2 | 9/2003 | Dawson |
| 6,861,029 | B2 | 3/2005 | Menk et al. |
| 6,939,414 | B2 | 9/2005 | Menk |
| 7,014,721 | B2 | 3/2006 | Shiga et al. |
| 7,081,172 | B2 | 7/2006 | Enya et al. |

OTHER PUBLICATIONS

Cesar Braga; Sorelmetal®; Ductile Iron Data for Design Engineers; Published by Rio Tinto Iron & Titanium, a member of the Ductile Iron Marketing Group; Revised/Reprinted 1998.

Ductile Iron Bomb Bodies; http://www.ductile.org/magazine/1998_3/bomb.htm; Jun. 1, 2007.

* cited by examiner

FERRITIC DUCTILE CAST IRON ALLOYS HAVING HIGH CARBON CONTENT, HIGH SILICON CONTENT, LOW NICKEL CONTENT AND FORMED WITHOUT ANNEALING

FIELD

The field of the invention relates to cast iron alloys, and in particular, ferritic ductile cast iron alloys. The disclosed cast iron alloys typically exhibit desirable characteristics such as sufficient toughness, tensile strength, yield strength, and elongation.

BACKGROUND

Cast irons are used for a wide variety of applications and industries that include government/defense, farm and heavy truck equipment, pumps, valves, and compressors. The basic types of cast iron may be categorized as: grey cast iron, where the graphite exists mainly as elongated flakes or lamellar particles; compacted graphite iron (CGI), where the graphite particles are elongated as in grey iron but are shorter and thicker and have rounded edges and irregular bumpy surfaces; malleable iron, where the graphite particles exist as compacted aggregates; and ductile iron, where the graphite particles exist as individual nodules or spheroids, and as such may be referred to as "nodular iron" or "spherulitic iron." The production, properties and applications of these irons is described in "The Iron Castings Handbook," Iron Castings Society (1981), C. F. Walton (Editor), which is incorporated herein by reference in its entirety. Of these irons, ductile iron has become the iron of choice for many applications because it is exhibits relatively high strength, toughness, and endurance limits. The properties of ductile iron are further described in the publication "A Design Engineer's Digest of Ductile Iron," (available fromthe Ductile Iron Marketing Group of the Ductile Iron Society at its website), which is incorporated herein by reference in its entirety.

Typically, the composition of unalloyed ductile iron is similar to that of grey iron with respect to the concentration of commonly present elements such as carbon, silicon, manganese, and phosphorus. The nodular or spherulitic structure of alloyed ductile iron is produced by adding one or more elements to the molten metal iron to promote nodules or spheroids (e.g., magnesium), such agents commonly being referred to as "nodularizing agents."

Ductile iron may be utilized as-cast or may be further treated. As-cast ductile iron may contain microstructure that influences the physical properties of the iron. For example, as-cast ductile iron may include pearlitic, ferritic, and/or cementitic microstructure. The relative amount of these microstructures will depend on the composition of the iron alloy and the process used for preparing the cast iron. After casting, the iron further may be treated in annealing, quenching, or tempering processes in order to alter the microstructure of the ductile iron and to obtain a finished ductile iron product having desirable physical properties (e.g., ferritic properties). However, these further treatments will add to the final cost of the finished ductile iron product. Methods for making ductile iron casting are described in U.S. Pat. Nos. 4,475,956 and 4,484,953, the contents of which are incorporated herein by reference.

Ferritic ductile iron (60-40-18) may be characterized as iron having at least about 60,000 psi tensile strength, at least about 40,000 psi yield strength, and at least about 18% elongation. In order to obtain a ductile iron with high elongation (e.g. 18% minimum), the ductile iron should have a relatively low percentage of pearlite in its microstructure. In order to minimize the amount of pearlite microstructure in the ductile iron, elements that promote pearlite microstructure should be minimized or avoided altogether, such as copper, manganese, and chromium. In addition, pearlite microstructure further can be minimized by adding elements that promote ferrite microstructure, such as silicon. However, in order to obtain ductile iron with relatively high impact properties, not only should pearlite microstructure be minimized but silicon should be kept at a level of about 1.95-2.25% by mass, because silicon is known as an element that embrittles the ferrite microstructure or shifts the brittle→ductile transition temperature for the iron alloy to higher temperatures. In other words, every iron alloy has a transition temperature where the fracture propagation system changes from brittle to ductile. As the amount of silicon in the alloy is increased, the temperature where a brittle fracture will occur is increased, causing the iron to have low impact resistance even at the higher temperature.

On the other hand, if the ductile iron contains only low levels of silicon, the iron will have relatively low strength. In addition, a ductile iron with relatively low pearlite microstructure will not have a tensile strength of at least about 60,000 psi and a yield strength of at least about 40,000 psi. In order to compensate for the reduced strength, nickel may be added to the alloy at a concentration of about 0.50-1.00% by mass. The presence of nickel in the alloy increases the tensile and yield strengths without promoting a large amount of pearlite, thereby promoting strength without compromising impact resistance. However, the relatively high cost of nickel will increase the cost of the final ductile iron product.

Therefore, it is desirable to obtain a ferritic ductile iron casting that does not require further treatment after casting (e.g., annealing) and that does not require the addition of nickel to the alloy.

SUMMARY

Disclosed are cast iron alloys. The disclosed cast alloys may include ferritic ductile cast iron alloys.

The disclosed cast iron alloys have desirable physical properties such as desirable toughness, strength, and elongation. In some embodiments, the cast iron alloys have a toughness of at least 6 ft.lb Charpy V at −20° F. and a toughness of at least 10 ft.lb Charpy V at +72° F. In other embodiments, the cast iron alloys have a tensile strength of at least about 60,000 psi. In further embodiments, the cast iron alloys have a yield strength of at least about 40,000 psi. In even further embodiments, the cast iron alloys have an elongation of at least about 18%.

The disclosed cast iron alloys typically have a chemical composition that is formulated to achieve the desirable physical properties of the cast iron alloys. In addition to iron, the alloys may include one or more non-ferrous elements (e.g., as positive additions or as present in the raw iron ore). In some embodiments, the cast iron alloys include one or more non-ferrous elements selected from the group consisting of Carbon (e.g., 3.30-3.85% Carbon by mass, and preferably 3.50-3.65% Carbon by mass), Silicon (e.g., 2.35-2.90% Silicon by mass, and preferably 2.40-2.60% Silicon by mass), Manganese (e.g., 0-0.40% Manganese by mass, and in some embodiments 0.10-0.40% or 0.15-0.25% Manganese by mass), and one or more nodularizing agents (e.g., 0.020-0.060% by mass), such as Magnesium (e.g., 0.025-0.045% Magnesium by mass, or preferably 0.030-0.035% Magnesium by mass).

In further embodiments, the cast iron alloys optionally include one or more non-ferrous elements selected from the group consisting of Copper (e.g., 0-0.15% Copper by mass, and in some embodiments 0.05-0.10% Copper by mass), Chromium (e.g., 0-0.10% Chromium by mass, and in some embodiments 0-0.050% Chromium by mass), Phosphorus (e.g., 0-0.050% Phosphorus by mass, and in some embodiments 0.010-0.020% Phosphorus by mass), Sulfur (e.g., 0-0.030% Sulfur by mass, and in some embodiments 0.008-0.015% Sulfur by mass), and Nickel (e.g., 0-0.25% Nickel by mass).

Typically, if the disclosed cast iron alloys include Nickel, the Nickel is present in the alloy at a relatively low concentration. Preferably, the cast iron alloy includes no more than 0.25%, 0.20%, 0.15%, 0.10%, or 0.05% Nickel by mass.

The cast iron alloys may include other incidental non-ferrous impurities (e.g., other than Carbon, Silicon, Manganese, Magnesium, Copper, Chromium, Phosphorus, Sulfur, and Nickel). In some embodiments, these other incidental non-ferrous impurities are present in the alloy at a relatively low concentration (e.g., 0-0.10% any other incidental non-ferrous impurities by mass).

The disclosed cast iron alloys may have a relatively high percentage of nodularity. In some embodiments, the disclosed cast iron alloys may have at least about 80% nodularity (or preferably at least about 90%, 95%, 97%, or 99% nodularity). The disclosed cast iron alloys may have a relative low percentage of pearlite. In some embodiments, the disclosed cast iron alloys may have no more than about 20% pearlite (or preferably no more than about 15%, 10%, 6%, 4%, or 2% pearlite).

The disclosed cast iron alloys typically are prepared by a suitable process in order to achieve the desirable physical properties of the cast iron alloys. In some embodiments, the disclosed cast iron alloys are prepared by a process that includes: (a) casting the iron alloy in a mold; and (b) cooling the cast iron alloy in the mold at a rate of no more than about 600° F./h. In some embodiments of the processes for preparing the cast iron alloys, the cast iron alloy is cooled at a rate of no more than about 500° F./h, or at a rate of no more than about 400° F./h, or at a rate of no more than about 300° F./h. Optionally, the methods do not include subjecting the cast iron to further treatment, such as annealing.

DETAILED DESCRIPTION

Figure 1:
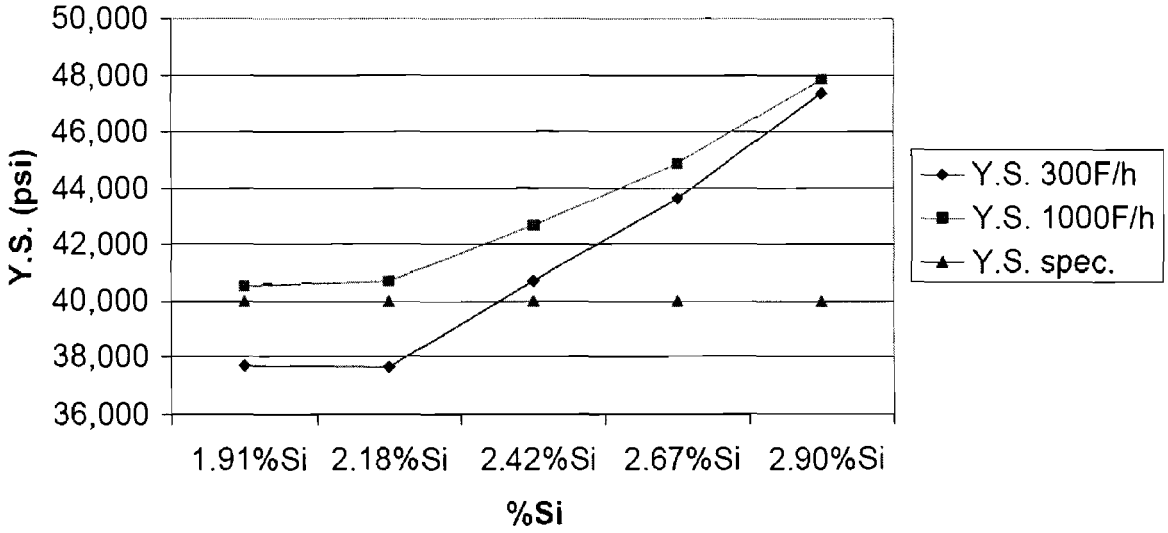
FIG. 1 illustrates the effect of varying the percentage of Silicon on D4018 yield strength in the presence of 0.22% Nickel and using two different cooling rates for the casting.

The present invention is described herein using definitions, as set forth below and throughout the application.

Unless otherwise noted, the terms used herein are to be understood according to conventional usage by those of ordinary skill in the relevant art. In addition to the definitions of terms provided below, it is to be understood that as used in the specification, embodiments, and in the claims, "a" or "an" can mean one or more, depending upon the context in which it is used.

As used herein, "about" and "substantially" will be understood by persons of ordinary skill in the art and will vary to some extent on the context in which they are used. If there are uses of the term which are not clear to persons of ordinary skill in the art given the context in which it is used, "about" will mean plus or minus up to 10% of the particular term and "substantially" will mean plus or minus more than 10% of the particular term.

As used herein, the term "nodularizing agent" means an agent present in or added to an iron alloy that promotes a nodular or spheroidal graphite structure in the cast iron alloy. Nodularizing agents may include Magnesium, rare earth elements or metals (e.g., Cerium and the other lanthanoids (i.e., Lanthanum, Praseodymium, Neodymium, Promethium, Samarium, Europium, Gadolinium, Terbium, Dyprosium, Holium, Erbium, Thulium, Ytterbium, and Lutetium), Scandium, Yttrium), actinoid elements, and mixtures thereof.

Silicon and Nickel commonly are alloyed with iron in order to obtain ferritic ductile iron having high strength and impact resistance. A method has been discovered for obtaining ferritic ductile iron having high strength and impact resistance without the use of significant amounts of Nickel. In some embodiments, the method includes alloying the iron with sufficient Silicon, casting the alloy in a mold, and cooling the castings in the mold at a desirable cooling rate (e.g., no more than 600° F./hour, and in some embodiments about 300-600° F./hour). The disclosed methods are economical and produce a tough and high strength ferritic ductile iron (e.g., by alloying the iron with Silicon, omitting the addition of Nickel to the alloy, keeping elements that promote pearlite microstructure at low levels in the alloy, and controlling the mold cooling rate after the alloy has been cast). In some embodiments, the cast iron alloy has desirable physical characteristics without having had to subject the casting to further treatment, such as annealing.

In some embodiments, the method includes: (a) casting an iron alloy melt (e.g., at a temperature greater than about 2500° F.) into substantially the shape of a desired part, the melt comprising by mass (or weight) 3.30-3.85% Carbon, 2.35-2.90% Silicon, 0-0.40% Manganese (in some embodiments 0.10-0.40% or 0.15-0.25% Manganese), 0.15% Copper maximum, 0.050% Phosphorous maximum, 0.030% Sulfur maximum, 0.10% Chromium maximum, 0.25% Nickel maximum, 0.020-0.060% nodularizing agent (e.g., Magnesium at 0.025-0.045% or 0.030-0.035%), and any other residual element at 0.10% maximum, the balance of Iron; (b) cooling the casting at a rate of no more than about 600° F./hour (e.g., at a rate of about 300-600° F./hour); and (c) removing the part out of the mold at a temperature below about 1300° F. Optionally, the method does not include subjecting the part to an annealing process.

The casting methods may be performed in a manner which achieves rapid solidification of the casting (e.g., in order to promote high nodule count in the casting) without rapid cooling of the casting (e.g., in order to minimize pearlite formation). In some embodiments, the casting methods may utilize green sand molds in order to achieve rapid solidification of the casting without rapid cooling of the casting (e.g, cooling at a rate of no more than 600° F./hour, preferably at a rate of about 300-600° F./hour).

ILLUSTRATIVE EMBODIMENTS

The following Embodiments are illustrative and are not intended to limit the scope of the claimed subject matter.

Embodiment 1. A cast iron alloy having one or more properties selected from the group consisting of: (a) a toughness of at least 6 ft.lb Charpy V at −20° F. and a toughness of at least 10 ft.lb Charpy V at +72° F.; (b) a tensile strength of at least about 60,000 psi; (c) a yield strength of at least about 40,000 psi; and (d) an elongation of at least about 18%.

Embodiment 2. The alloy of embodiment 1, comprising: 3.30-3.85% Carbon by mass; 2.35-2.90% Silicon by mass; and 0-0.25% Nickel by mass.

Embodiment 3. The alloy of embodiment 1 or 2, comprising one or more of the following: 0-0.40% Manganese by mass (in some embodiments 0.10-0.40% or 0.15-0.25% Manganese by mass); 0-0.15% Copper by mass (in some embodiments 0-0.10% Copper by mass); 0-0.10% Chromium by mass (in some embodiments 0-0.05% Chromium by mass); 0-0.050% Phosphorus by mass (in some embodiments 0-0.025% Phosphorus by mass); 0-0.030% Sulfur by mass (in some embodiments 0-0.020% Sulfur by mass); and 0.020-0.060% nodularizing agent by mass (e.g., Magnesium, optionally at a concentration of 0.025-0.45% or 0.030-0.035% by mass).

Embodiment 4. The alloy of any of embodiments 1-3, comprising 0-0.10% any other incidental non-ferrous impurities by mass.

Embodiment 5. The alloy of any of embodiments 1-4, comprising 3.50-3.65% Carbon by mass.

Embodiment 6. The alloy of any of embodiments 1-5, comprising 2.40-2.60% Silicon by mass.

Embodiment 7. The alloy of any of embodiments 1-6, comprising 0.15-0.25% Manganese by mass.

Embodiment 8. The alloy of any of embodiments 1-7, comprising 0.05-0.10% Copper by mass.

Embodiment 9. The alloy of any of embodiments 1-8, comprising 0.010-0.020% Phosphorus by mass.

Embodiment 10. The alloy of any of embodiments 1-9, comprising 0.008-0.015% Sulfur by mass.

Embodiment 11. The alloy of any of embodiments 1-10, comprising 0.030-0.035% Magnesium by mass.

Embodiment 12. The alloy of any of embodiments 1-11, comprising 0-0.20%, 0-0.15%, 0-0.10%, or 0-0.05% Nickel by mass.

Embodiment 13. A process for making the cast iron alloy of any of embodiments 1-15, comprising: (a) casting the iron alloy in a mold; and (b) cooling the cast iron alloy in the mold at a rate of no more than about 600° F./h.

Embodiment 14. The process of embodiment 13, comprising cooling the cast iron alloy in the mold at a rate of no more than about 500° F./h.

Embodiment 15. The process of embodiment 13, comprising cooling the cast iron alloy in the mold at a rate of no more than about 300° F./h.

Embodiment 16. A process for making a cast iron alloy having one or more properties selected from the group consisting of: (a) a toughness of at least 6 ft.lb Charpy V at −20° F. and a toughness of at least 10 ft.lb Charpy V at +72° F.; (b) a tensile strength of at least about 60,000 psi; (c) a yield strength of at least about 40,000 psi; and (d) an elongation of at least about 18%; the process comprising casting the iron alloy in a mold and cooling the cast iron alloy in the mold at a rate of no more than about 600° F./h.

Embodiment 17. The process of embodiment 16, the alloy comprising: 3.30-3.85% Carbon by mass; 2.35-2.90% Silicon by mass; and 0-0.25% Nickel by mass.

Embodiment 18. The process of embodiment 16 or 17, the alloy comprising one or more of the following: 0-0.40% Manganese by mass (in some embodiments 0.10-0.40% or 0.15-0.25% Manganese by mass); 0-0.15% Copper by mass (in some embodiments 0-0.10% Copper by mass); 0-0.10% Chromium by mass (in some embodiments 0-0.05% Chromium by mass); 0-0.050% Phosphorus by mass (in some embodiments 0-0.025% Phosphorus by mass); 0-0.030% Sulfur by mass (in some embodiments 0-0.020% Sulfur by mass); and 0.020-0.060% nodularizing agent by mass (e.g., Magnesium, optionally at a concentration of 0.025-0.45% or 0.030-0.035% by mass).

Embodiment 19. The process of any of embodiments 16-18, the alloy comprising 0-0.10% any other incidental non-ferrous impurities by mass.

Embodiment 20. The process of any of embodiments 16-19, the alloy comprising 3.50-3.65% Carbon by mass.

Embodiment 21. The process of any of embodiments 16-20, the alloy comprising 2.40-2.60% Silicon by mass.

Embodiment 22. The process of any of embodiments 16-21, the alloy comprising 0.15-0.25% Manganese by mass.

Embodiment 23. The process of any of embodiments 16-22, the alloy comprising 0.05-0.10% Copper by mass.

Embodiment 24. The process of any of embodiments 16-23, the alloy comprising 0.010-0.020% Phosphorus by mass.

Embodiment 25. The process of any of embodiments 16-24, the alloy comprising 00.008-0.015% Sulfur by mass.

Embodiment 26. The process of any of embodiments 16-25, the alloy comprising 0.030-0.035% Magnesium by mass.

Embodiment 27. The process of any of embodiments 16-26, the alloy comprising 0-0.20%, 0-0.15%, 0-0.10%, or 0-0.05% Nickel by mass.

Embodiment 28. The cast iron alloy produced by any of the processes of embodiments 16-27.

EXAMPLES

The following Examples are illustrative and are not intended to limit the scope of the claimed subject matter.

Example 1

Ductile iron test bars were cast in green sand molds using varying levels of Silicon, Nickel, and Manganese. The castings were cooled by one of two methods: "300° F./Hour" or "1000° F./hour." The cooling method of "300° F./h" was performed by heating the test bar in an oven at 1650° F.; cooling the test bar at a controlled rate of 300° F./h to 1250° F.; and then allowing the test bar to further cool uncontrolled in air. The cooling method of "1000° F./h" was performed by pouring the liquid iron in a sand mold and allowing the iron to cool uncontrolled in the mold. The mechanical properties of the test bars then were assessed, including tensile strength (according to ASTM E8), yield strength (using ASTM A 536 "Y" block test bars), impact resistance (using Charpy V notch specimens according to ASTM E23 at −20° F. and at 72° F.), and elongation.

Figure 2:
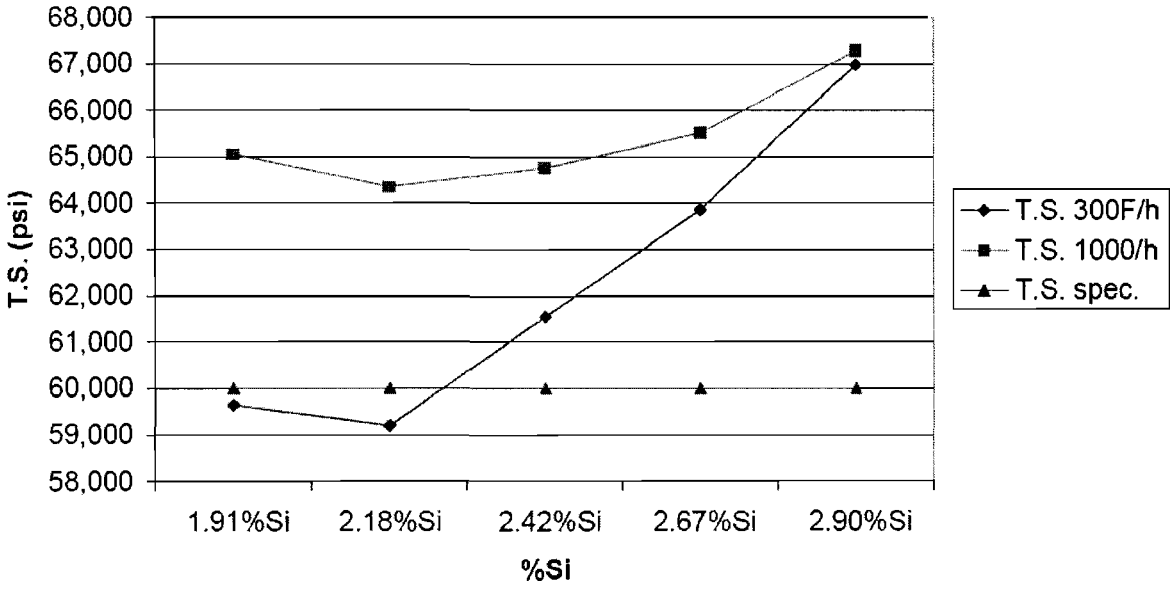
FIG. 2 illustrates the effect of varying the percentage of Silicon on D4018 tensile strength in the presence of 0.22% Nickel and using two different cooling rates for the casting.
Figure 3:
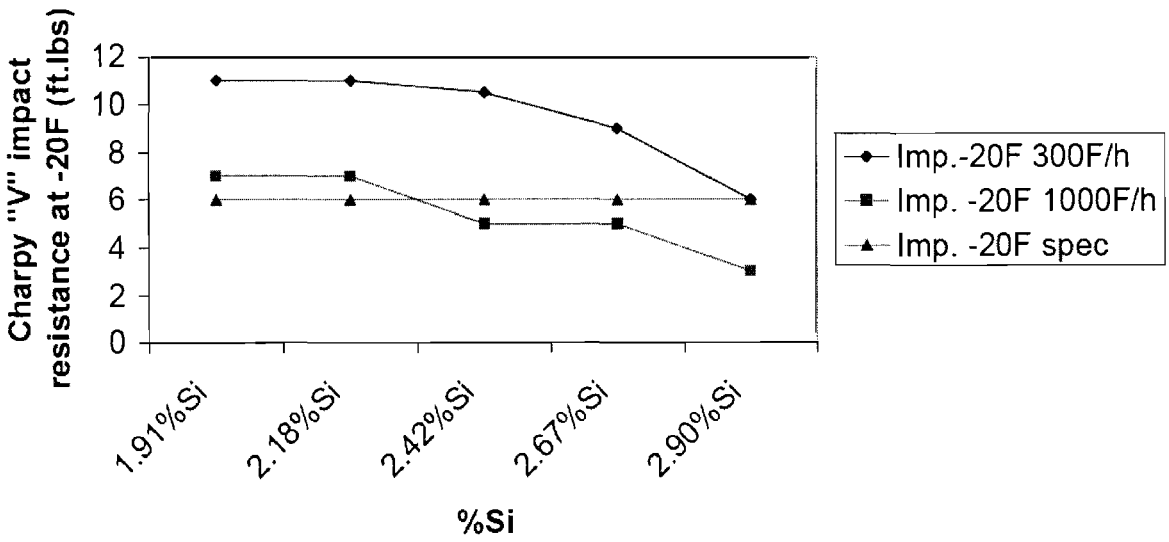
FIG. 3 illustrates the effect of varying the percentage of Silicon on D4018 toughness at −20° F. in the presence of 0.22% Nickel and using two different cooling rates for the casting.
Figure 4:
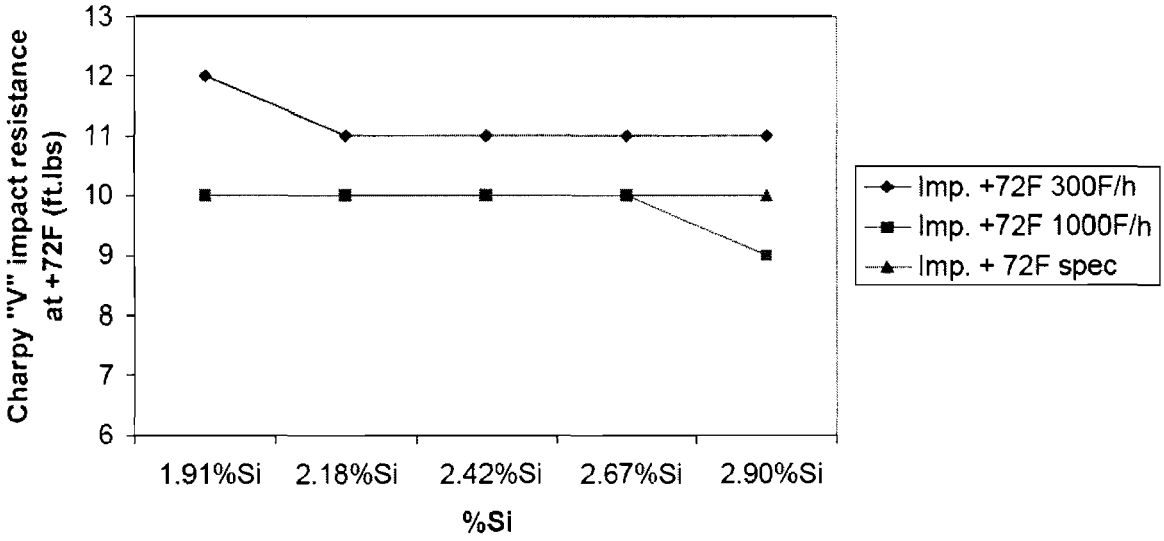
FIG. 4 illustrates the effect of varying the percentage of Silicon on D4018 toughness at +72° F. in the presence of 0.22% Nickel and using two different cooling rates for the casting.

Silicon levels in the test bars were varied as follows: (1.91%, 2.18%, 2.42%, 2.67%, or 2.90%); using a base chemistry as follows: Carbon (3.8%); Manganese (0.17%); Copper (0.05%); and Nickel (0.22%). The mechanical properties of these test bars are illustrated in Table 1 and in FIGS. 1-4.

TABLE 1

| Chemistry | T.S. 300 F./h | T.S. 1000/h | Y.S. 300 F./h | Y.S. 1000 F./h | Elong. 300 F./h | Elong. 1000 F./h | Imp. −20 F. 300 F./h | Imp. −20 F. 1000 F./h | Imp. +72 F. 300 F./h | Imp. +72 F. 1000 F./h |
|---|---|---|---|---|---|---|---|---|---|---|
| 1.91% Si | 59,634 | 65,054 | 37,693 | 40,540 | 25 | 18.5 | 11 | 7 | 12 | 10 |
| 2.18% Si | 59,197 | 64,355 | 37,643 | 40,690 | 27 | 19 | 11 | 7 | 11 | 10 |
| 2.42% Si | 61,546 | 64,754 | 40,712 | 42,687 | 26 | 19 | 10.5 | 5 | 11 | 10 |
| 2.67% Si | 63,861 | 65,503 | 43,631 | 44,884 | 26 | 21 | 9 | 5 | 11 | 10 |
| 2.90% Si | 66,981 | 67,283 | 47,355 | 47,858 | 25 | 20 | 6 | 3 | 11 | 9 |

Figure 5:
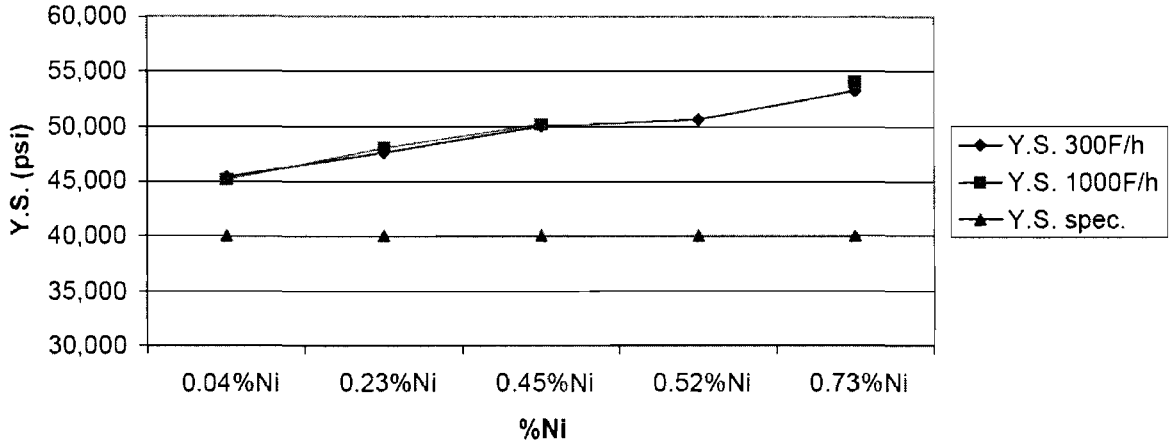
FIG. 5 illustrates the effect of varying the percentage of Nickel on D4018 yield strength in the presence of 2.76% Silicon and using two different cooling rates for the casting.
Figure 6:
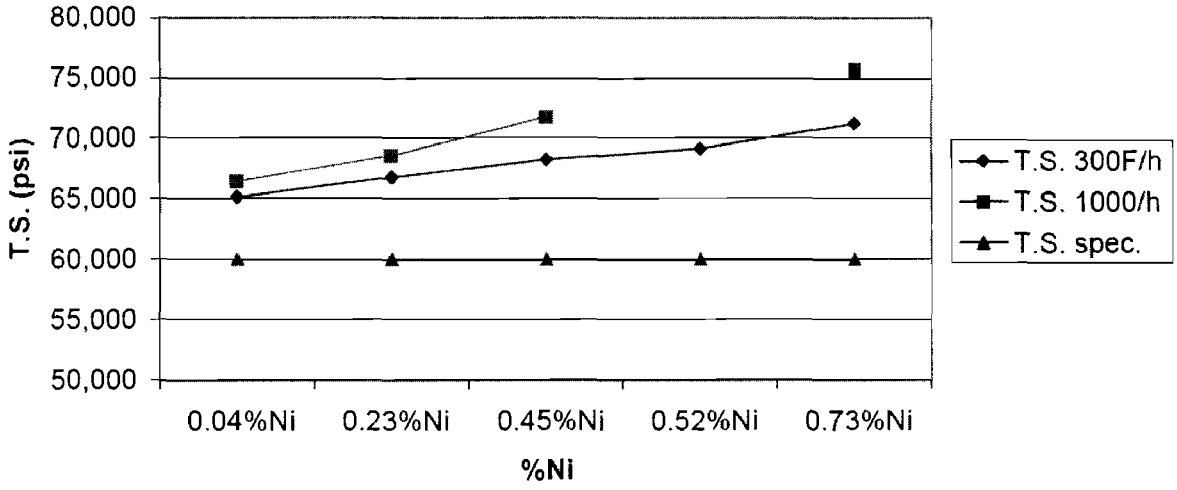
FIG. 6 illustrates the effect of varying the percentage of Nickel on D4018 tensile strength in the presence of 2.76% Silicon and using two different cooling rates for the casting.
Figure 7:
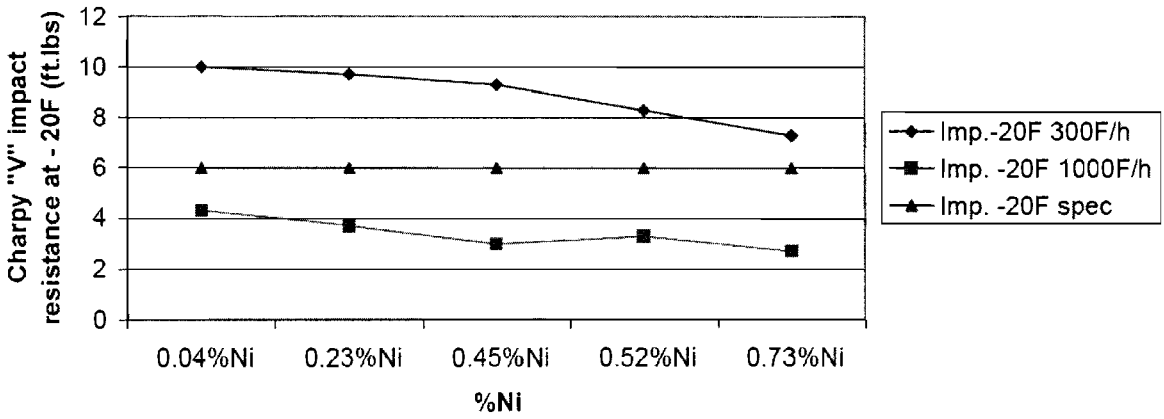
FIG. 7 illustrates the effect of varying the percentage of Nickel on D4018 toughness at −20° F. in the presence of 2.76% Silicon and using two different cooling rates for the casting.
Figure 8:
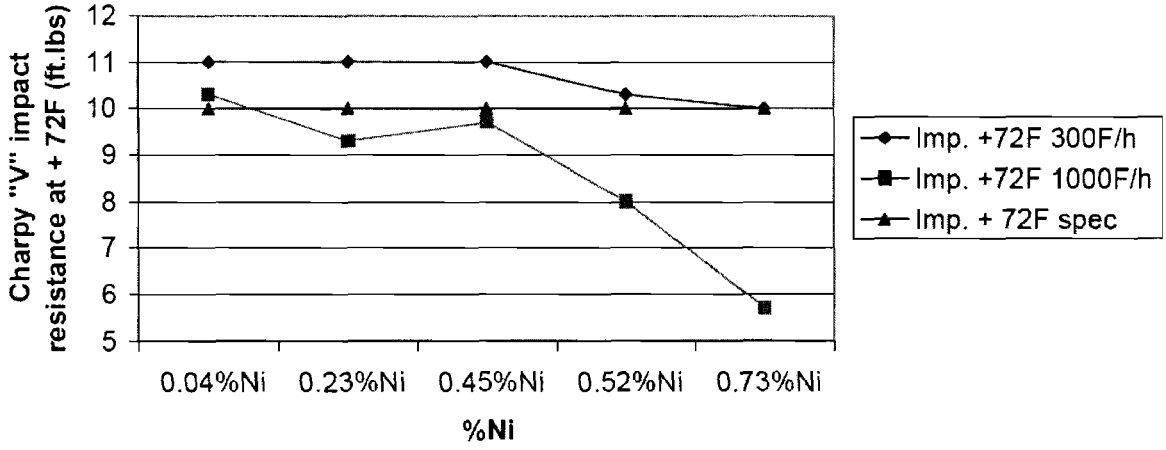
FIG. 8 illustrates the effect of varying the percentage of Nickel on D4018 toughness at +72° F. in the presence of 2.76% Silicon and using two different cooling rates for the casting.

Nickel levels in the test bars were varied as follows: (0.04%, 0.23%, 0.45%, 0.52%, or 0.73%); using a base chemistry as follows: Carbon (3.72%), Silicon (2.76% (average)), Manganese (0.23%), and Copper (0.11%). The mechanical properties of these test bars are illustrated in Table 2 and in FIGS. 4-8.

TABLE 2

| Chemistry | T.S. 300 F./h | T.S. 1000/h | Y.S. 300 F./h | Y.S. 1000 F./h | Elong. 300 F./h | Elong. 1000 F./h | Imp. −20 F. 300 F./h | Imp. −20 F. 1000 F./h | Imp. +72 F. 300 F./h | Imp. +72 F. 1000 F./h |
|---|---|---|---|---|---|---|---|---|---|---|
| 0.04% Ni | 65,169 | 66,428 | 45,392 | 45,090 | 20.5 | 19 | 10 | 4.3 | 11 | 10.3 |
| 0.23% Ni | 66,766 | 68,541 | 47,568 | 48,009 | 20 | 18.5 | 9.7 | 3.7 | 11 | 9.3 |
| 0.45% Ni | 68,239 | 71,762 | 50,022 | 50,223 | 20 | 16 | 9.3 | 3 | 11 | 9.7 |
| 0.52% Ni | 69,145 | | 50,626 | | 20 | | 8.3 | 3.3 | 10.3 | 8 |
| 0.73% Ni | 71,208 | 75,638 | 53,293 | 54,034 | 18.5 | 12.5 | 7.3 | 2.7 | 10 | 5.7 |

Figure 9:
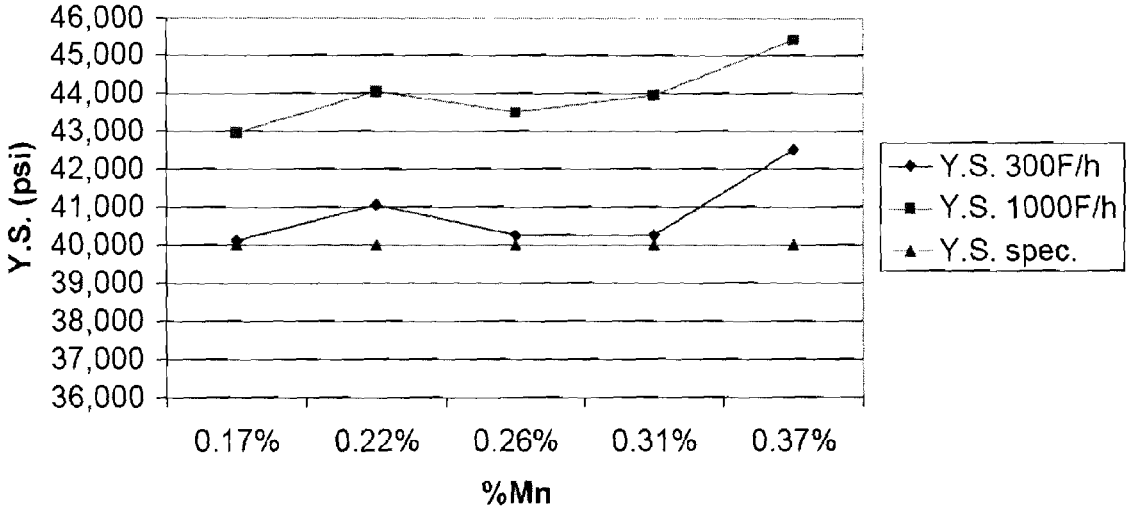
FIG. 9 illustrates the effect of varying the percentage of Manganese on D4018 yield strength in the presence of 0.23% Nickel and using two different cooling rates for the casting.
Figure 10:
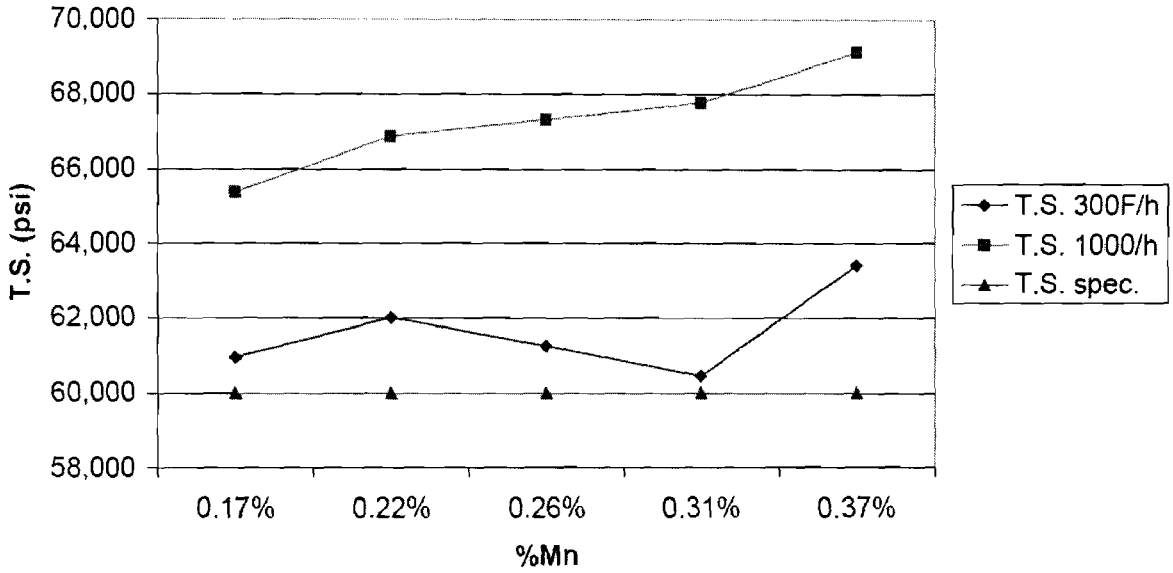
FIG. 10 illustrates the effect of varying the percentage of Manganese on D4018 tensile strength in the presence of 0.23% Nickel and using two different cooling rates for the casting.
Figure 11:
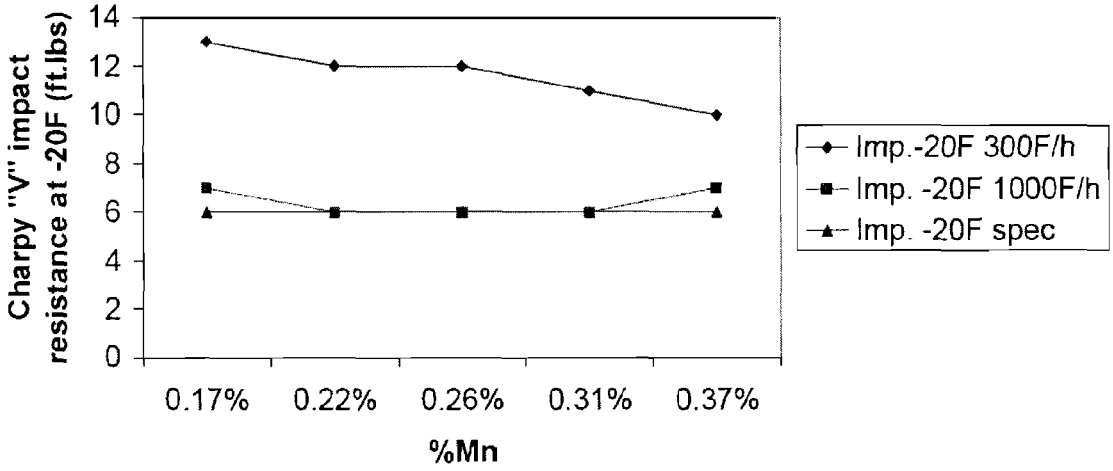
FIG. 11 illustrates the effect of varying the percentage of Manganese on D4018 toughness at −20° F. in the presence of 0.23% Nickel and using two different cooling rates for the casting.
Figure 12:
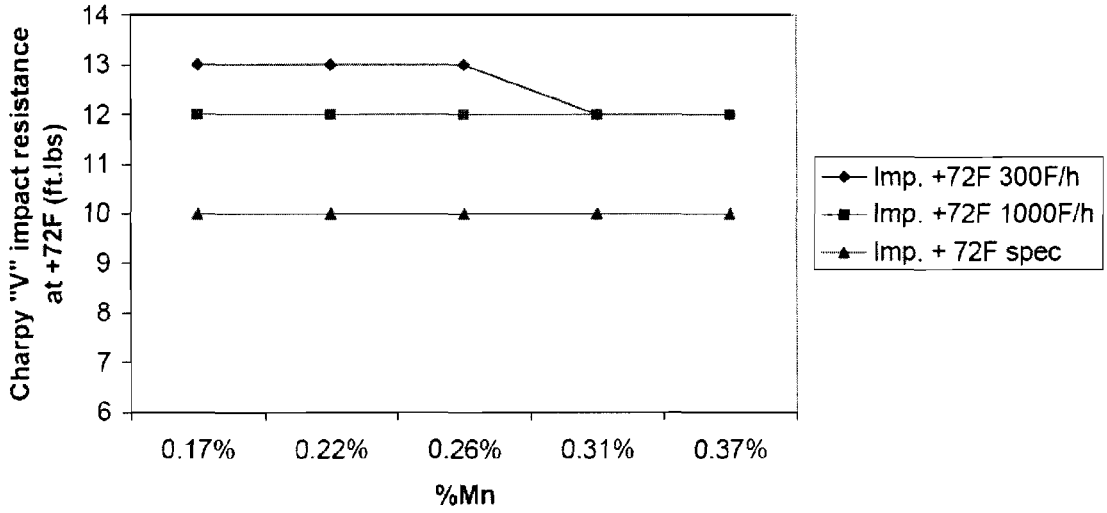
FIG. 12 illustrates the effect of varying the percentage of Manganese on D4018 toughness at +72° F. in the presence of 0.23% Nickel and using two different cooling rates for the casting.

Manganese levels in the test bars were varied as follows: (0.17%, 0.22%, 0.26%, 0.31%, or 0.37%); using a base chemistry as follows: Carbon (3.75%), Silicon (2.36% (average)), Nickel (0.23%), and Copper (0.05%). The mechanical properties of these test bars are illustrated in Tables 3 and in FIGS. 9-12.

TABLE 3

| Chemistry | T.S. 300 F./h | T.S. 1000/h | Y.S. 300 F./h | Y.S. 1000 F./h | Elong. 300 F./h | Elong. 1000 F./h | Imp. −20 F. 300 F./h | Imp. −20 F. 1000 F./h | Imp. +72 F. 300 F./h | Imp. +72 F. 1000 F./h |
|---|---|---|---|---|---|---|---|---|---|---|
| 0.17% Mn | 60,951 | 65,362 | 40,100 | 42,957 | 26 | 20 | 6013 | 7 | 13 | 12 |
| 0.22% Mn | 62,004 | 66,866 | 41,052 | 44,059 | 27 | 18 | 12 | 6 | 13 | 12 |
| 0.26% Mn | 61,252 | 67,317 | 40,250 | 43,508 | 27 | 18 | 12 | 6 | 13 | 12 |
| 0.31% Mn | 60,454 | 67,768 | 40,250 | 43,959 | 28 | 19 | 11 | 6 | 12 | 12 |
| 0.37% Mn | 63,407 | 69,122 | 42,505 | 45,413 | 26 | 19 | 10 | 7 | 12 | 12 |

Example 2

Test bar and castings were prepared having one of the the following two chemistries: Chemistry #1-Carbon (3.80%), Silicon (2.31%), Manganese (0.19%), Copper (0.08%), and Nickel (0.02%); Chemistry #2-Carbon (3.80%); Silicon (2.39%); Manganese (0.17%); Copper (0.09%); and Nickel (0.02%). After the iron melts were poured in the molds to make the castings, the molds were cooled at a controlled rate of about 300-500° F./hour. The mechanical properties of the test bar and castings having the two chemistries then were assessed and the results are presented in Tables 4-5.

TABLE 4

| | | Casting Results Segment | | | | | |
|---|---|---|---|---|---|---|---|
| | Test Bar Results | 1 Nose Cope | 2 Nose Drag | 3 Middle Cope | 4 Middle Drag | 5 Tail Cope | 6 Tail Drag |
| T.S. (Psi) | 61,185 | 58,595 | 58,796 | 58,796 | 58,245 | 59,047 | 58,194 |
| Y.S. (Psi) | 39,510 | 38,345 | 38,596 | 38,796 | 38,445 | 38,596 | 38,846 |
| Elong. (%) | 26 | 25 | 26 | 25 | 23 | 18 | 13 |
| Charpy V at: | | | | | | | |
| −40 F. | | | | | 5.0 | | |
| −20 F. | 7 | | | | 7.0 | | |
| 0 F. | | | | | 11.0 | | |
| 20 F. | | | | | 12.0 | | |
| 40 F. | | | | | 13.0 | | |
| 72 F. | 12 | | | | 13.0 | | |

TABLE 5

| | | Casting Results Segment | | | | | |
|---|---|---|---|---|---|---|---|
| | Test Bar Results | 1 Nose Cope | 2 Nose Drag | 3 Middle Cope | 4 Middle Drag | 5 Tail Cope | 6 Tail Drag |
| T.S. (Psi) | 61,904 | 61,144 | 61,194 | 62,745 | 62,542 | 60,708 | 63,356 |
| Y.S. (Psi) | 40,400 | 40,058 | 40,108 | 41,355 | 40,744 | 40,744 | 41,355 |
| Elong. (%) | 25 | 21 | 23 | 15 | 23 | 11 | 21 |
| Charpy V at: | | | | | | | |
| −40 F. | | | | | 6.0 | | |
| −20 F. | 8 | | | | 7.0 | | |
| 0 F. | | | | | 9.0 | | |
| 20 F. | | | | | 10.0 | | |
| 40 F. | | | | | 11.0 | | |
| 72 F. | 12 | | | | 11.0 | | |
| % Nodularity | 96 | | | | | | |
| Nodules Count | 173 | | | | | | |
| % Pearlite | 6 | | | | | | |

I claim:

1. A cast iron alloy having:

a toughness of at least 6 ft. lb Charpy V at −20° F. and a toughness of at least 10 ft. lb Charpy V at +72° F.;

a tensile strength of at least 60,000 psi;

a yield strength of at least 40,000 psi; and an elongation of at least 18%;

the alloy comprising:

(a) 3.30-3.85% Carbon by mass;

(b) 2.35-2.90% Silicon by mass;

(c) 0.020-0.060% nodularizing agent by mass;

(d) 0-0.40% Manganese by mass;

(e) 0-0.15% Copper by mass;

(f) 0-0.10% Chromium by mass;

(g) 0-0.050% Phosphorus by mass;

(h) 0-0.030% Sulfur by mass;

(i) 0-0.25% Nickel by mass;

(j) 0-0.10% any other incidental non-ferrous impurities by mass; and (k) balance up to 100% of Iron;

wherein the cast iron alloy is prepared by a process comprising the steps of casting the iron alloy in a mold and cooling the cast iron alloy in the mold at a rate of no more than about 600° F./h, wherein the process does not include annealing.

2. The alloy of claim 1, comprising 3.50-3.65% Carbon by mass.

3. The alloy of claim 1, comprising 2.40-2.60% Silicon by mass.

4. The alloy of claim 1, wherein the nodularizing agent is Magnesium present at a concentration of 0.025-0.045% by mass.

5. The alloy of claim 4, comprising 0.030-0.035% Magnesium by mass.

6. The alloy of claim 1, comprising 0.15-0.25% Manganese by mass.

7. The alloy of claim 1, comprising 0-0.10% Copper by mass.

8. The alloy of claim 1, comprising 0-0.020% Phosphorus by mass.

9. The alloy of claim 1, comprising 0-0.015% Sulfur by mass.

10. The alloy of claim 1, comprising 0-0.20% Nickel by mass.

11. The alloy of claim 1, comprising 0-0.15% Nickel by mass.

12. The alloy of claim 1, comprising 0-0.10% Nickel by mass.

13. The alloy of claim 1, comprising 0-0.05% Nickel by mass.

14. A process for making a cast iron alloy, the alloy having a toughness of at least 6 ft.lb Charpy V at −20° F. and a toughness of at least 10 ft.lb Charpy V at +72° F.; the alloy having a tensile strength of at least 60,000 psi; the alloy having a yield strength of at least 40,000 psi; and the alloy having an elongation of at least 18%;

the process comprising:

(a) casting the iron alloy in a mold, the alloy comprising:

(i) 3.30-3.85% Carbon by mass;

(ii) 2.35-2.90% Silicon by mass;

(iii) 0.020-0.060% nodularizing agent by mass;

(iv) 0-0.40% Manganese by mass;

(v) 0-0.15% Copper by mass;

(vi) 0-0.10% Chromium by mass;

(vii) 0-0.050% Phosphorus by mass;

(viii) 0-0.030% Sulfur by mass;

(ix) 0-0.25% Nickel by mass;

(x) 0-0.10% any other incidental non-ferrous impurities by mass; and (xi) balance up to 100% of Iron;

(b) cooling the cast iron alloy in the mold at a rate of no more than about 600° F./h;

wherein the process does not include annealing.

15. The process of claim 14, comprising cooling the cast iron alloy in the mold at a rate of no more than about 500° F./h.

16. The process of claim 14, comprising cooling the cast iron alloy in the mold at a rate of no more than about 300° F./h.

17. The process of claim 14, wherein the alloy comprises 3.50-3.65% Carbon by mass.

18. The process of claim 14, wherein the alloy comprises 2.40-2.60% Silicon by mass.

19. The process of claim 14, wherein the nodularizing agent is Magnesium present at a concentration of 0.025-0.045% by mass.

20. The process of claim 19, wherein the alloy comprises 0.030-0.035% Magnesium by mass.

21. The process of claim 14, wherein the alloy comprises 0.15-0.25% Manganese by mass.

22. The process of claim 14, wherein the alloy comprises 0-0.10% Copper by mass.

23. The process of claim 14, wherein the alloy comprises 0-0.0.20% Phosphorus by mass.

24. The process of claim 14, wherein the alloy comprises 0-0.015% Sulfur by mass.

25. The process of claim 14, wherein the alloy comprises 0-0.20% Nickel by mass.

26. The process of claim 14, wherein the alloy comprises 0-0.15% Nickel by mass.

27. The process of claim 14, wherein the alloy comprises 0-0.10% Nickel by mass.

28. The process of claim 14, wherein the alloy comprises 0-0.05% Nickel by mass.

* * * * *